United States Patent [19]

Dyer

[11] 4,248,021

[45] Feb. 3, 1981

[54] SUPPORT MEANS FOR WALL OR ROOF STRUCTURE

[75] Inventor: Frederick W. Dyer, Burlington, Canada

[73] Assignee: H. H. Robertson Company, Pittsburgh, Pa.

[21] Appl. No.: 68,501

[22] Filed: Aug. 22, 1979

[51] Int. Cl.[3] ..... E04B 1/74

[52] U.S. Cl. ..... 52/404; 52/483

[58] Field of Search ..... 52/404, 410, 483, 408, 52/481, 714, 809, 717, 508, 461

[56] References Cited

U.S. PATENT DOCUMENTS

| | | | |
|---|---|---|---|
| 2,841,253 | 7/1958 | Coffman et al. . | |
| 2,876,871 | 3/1959 | Coffman et al. . | |
| 3,054,482 | 9/1962 | Lassen . | |
| 3,300,934 | 1/1967 | Waizenhofer | 52/404 X |
| 3,324,617 | 6/1967 | Knight et al. | 52/404 X |
| 3,474,583 | 10/1969 | Manias | 52/404 X |
| 3,486,284 | 12/1969 | Steinberger et al. | 52/404 X |
| 3,533,205 | 10/1970 | Pestel et al. | 52/714 X |
| 3,557,507 | 1/1971 | Wilder | 52/404 |
| 4,014,150 | 3/1977 | Wells et al. | 52/461 |
| 4,044,521 | 8/1977 | Fischer et al. | 52/404 |
| 4,081,938 | 4/1978 | Bertacchi et al. | 52/483 X |

FOREIGN PATENT DOCUMENTS

| | | | |
|---|---|---|---|
| 566913 | 8/1977 | U.S.S.R. | 52/404 |

*Primary Examiner*—J. Karl Bell

*Attorney, Agent, or Firm*—George E. Manias

[57] ABSTRACT

A roof or wall structure incorporating support assemblies of this invention is disclosed. The roof or wall structure comprises an inner sheath secured to plural spaced-apart purlins or girts; an outer sheath; plural spaced-apart support means each assembled from a plurality of the present support means, secured to the inner sheath and to the outer sheath for maintaining the outer sheath spaced from the inner sheath; and thermal insulation filling the space between the inner and outer sheaths. The arrangement is such that the thermal insulation has a substantially uniform thickness throughout the roof or wall structure. The depth of the support means may be varied to accommodate the desired thickness of thermal insulation. The support means accommodate thermal expansion and contraction of the outer sheath independently of the inner sheath, thereby totally eliminating the possibility of leaks associated with prior art structures.

14 Claims, 9 Drawing Figures

SUPPORT MEANS FOR WALL OR ROOF STRUCTURE

This invention relates to insulated, double-sheath roof or wall structures, and more particularly to improved support means for maintaining the outer sheath spaced from the inner sheath without undesirable compression of the insulation.

Building structures, such as pre-engineered metal buildings, require thermal insulation to minimize energy losses caused by the relatively high thermal conductance of the metal components of the building. Numerous insulating systems are disclosed in the prior art.

Insulated wall structures are known comprising inner and outer sheets maintained in spaced-apart relation by a subgirt structure, and a layer of thermal insulation therebetween. In one such wall structure, the outer sheets are connected to the inner sheets by a plurality of end interconnected subgirts. The subgirts are in direct contact with the outer sheets and with the inner sheets thereby providing a relatively free path for the through conduction of heat. See, for example, U.S. Pat. Nos. 2,841,253 (COFFMAN et al); 2,876,871 (COFFMAN et al); 3,054,482 (LASSEN).

In a similar wall structure, the subgirt structure comprises elongated subgirts and spaced-apart clips having low thermal conductance. To achieve a surprisingly low overall heat-transfer coefficient, the structure requires a vapor barrier between the insulation and the inner panels, and requires inserts which minimize convection circulation of air within the wall. While the structure has an excellent low overall heat-transfer coefficient, no means is provided for accommodating thermal expansion and contraction of the outer sheet. See U.S. Pat. No. 3,474,583 (MANIAS).

Single skin roof structures are known comprising blanket-type glass fiber insulation extending across the tops of supporting purlins, and an outer skin overlying the insulation. When the outer skin is secured to the supporting purlins, the insulation therebetween is almost totally compressed. The compressed insulation loses up to 50% of its R-value and undergoes a reduction in thickness in the region between adjacent purlins. A recently disclosed roof insulating system is useful in overcoming the drastic loss of R-value. The system requires four distinct insulating means. The system does not accommodate thermal expansion and contraction of the outer skin. See U.S. Pat. No. 4,014,150 (WELLS et al).

Single skin roof structures may also be subject to objectionable moisture condensation. That is, the outer skin fasteners, the shanks of which are exposed inside of the building, constitute thermal paths for through conduction of heat and cold. During winter weather, the interaction of the thermal paths with the heated interior air can result in condensation of moisture on the fastener shanks, and dripping of water from the ceiling.

Broadly the present invention provides a wall or roof structure comprising an inner sheath extending across and secured to each of a plurality of spaced-apart girts or purlins, an outer sheath, and plural support means extending transversely of the outer sheath and supporting the outer sheath in spaced-apart relation with the inner sheath. Each of the support means comprises a plurality of axially spaced-apart clips having connecting webs generally normal to the inner sheath, first legs extending from outboard ends of the webs, and bases at the inboard ends of the webs secured to the inner sheath. A plurality of axially aligned subgirts are provided having first ends overlying the first legs of the clips and second ends overlapping the first ends of the next-in-line subgirts. The outer sheath is secured to the subgirts. First connecting means is provided slideably connecting the second ends of the subgirts to the adjacent clips for movement parallel to the plane of the first legs thereby to accommodate thermal expansion and contraction of the outer sheath. Second connecting means is provided connecting the second ends of the subgirts to the first ends against disengagement thereof by negative or suction loads. Thermal insulation is disposed in the space between the inner and outer sheaths. The arrangement is such that the insulation has a substantially uniform thickness throughout the roof or wall structure.

The present invention also may be employed to increase thermal insulating efficiency of existing roof or wall structures. In this instance the existing roof or wall panel constitute the above-mentioned inner sheath.

The present invention also provides a two-piece support assembly for sheathing panels comprising a clip having a connecting web, a first leg extending laterally from an upper web end and a base at a lower web end, and a first slot provided in the connecting web which is spaced from and extends generally parallel with the first leg. A subgirt is provided having a first end overlying the first leg and a second end remote from the first leg. The subgirt includes an end plate extending therefrom in overlapping relation with the connecting web. A connecting strip extends from the end plate through the first slot and is inclined relative to the end plate toward the first leg thereby slideably connecting the first end of the subgirt to the clip. The width of the connecting strip is less than the length of the slot whereby the subgirt is moveable in the plane of the first leg. The subgirt additionally includes a tongue extending longitudinally outwardly from the second end, and a second slot provided in an exterior face of the first end of the subgirt but spaced from the end plate. The arrangement is such that a plurality of these support assemblies may be installed in axially aligned relation with the subgirts thereof in end-overlapped relation, and with the tongue of each support assembly engaged in the second slot of the adjacent support assembly.

The principal object of this invention is to provide an insulating system for a wall or roof structure which avoids compression of the insulation and the loss of insulating value resulting from such compression.

Still another object of this invention is to provide an insulated wall or roof structure which accommodates thermal expansion and contraction of the exterior sheets.

Still another object of this invention is to provide support means disposed between inner and outer sheets, which support means may be varied to accommodate various thicknesses of insulation.

In drawings which illustrate embodiments of the invention,

Figure 9:
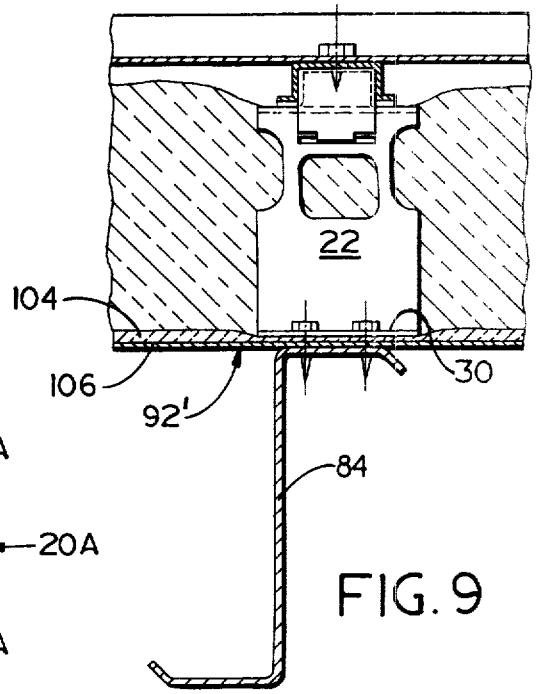
Figure 8:
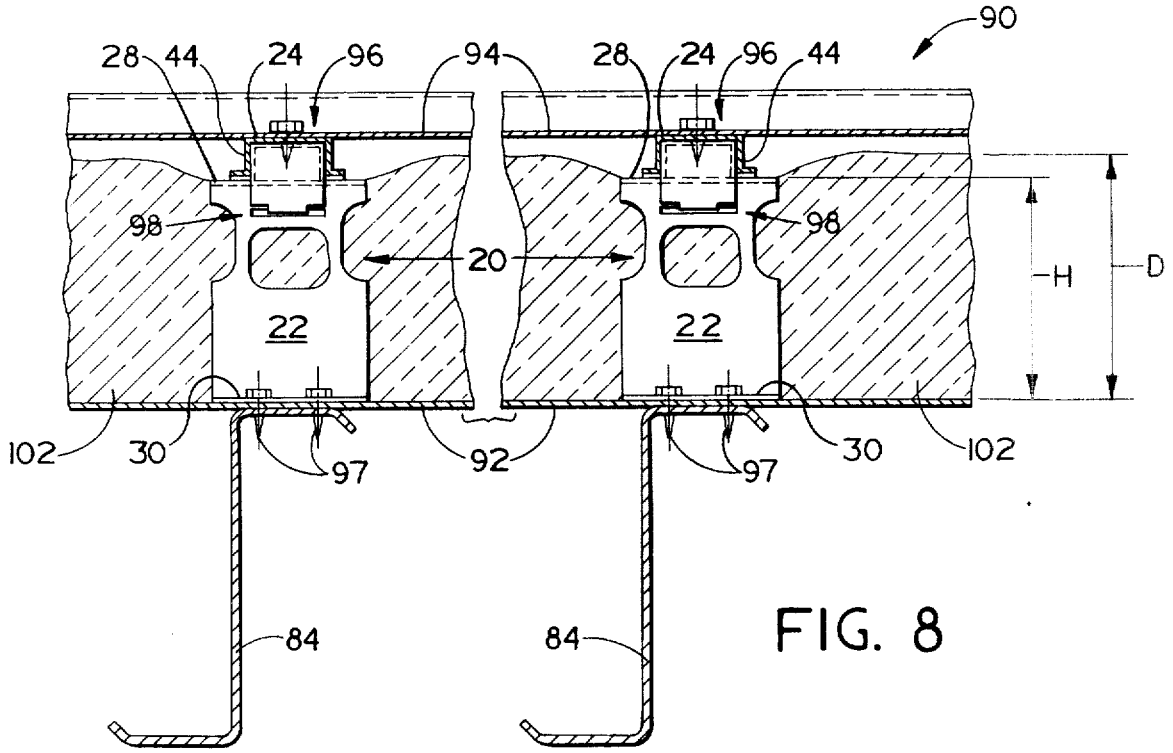
FIG. 8 is a broken cross-sectional view taken along the line 8—8 of FIG. 7.

FIG. 9, appearing on Sheet 2, is a cross-sectional view similar to FIG. 8 illustrating an alternative arrangement.

The present invention provides a two-piece support assembly 20 (FIG. 1) for sheathing panels, comprising a clip 22 and a subgirt 24.

Figure 1:
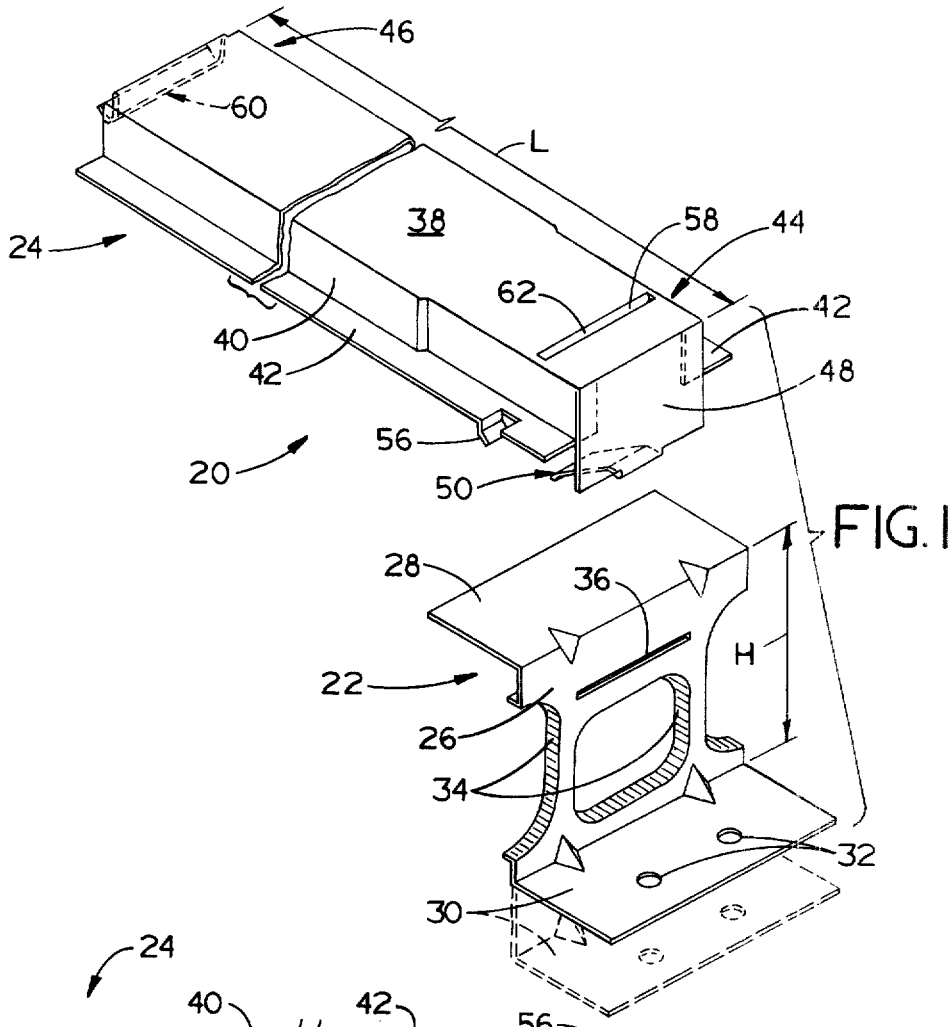
FIG. 1 is an isometric view in exploded form, illustrating the clip and subgirt components of the support assembly of this invention.

The clip 22 comprises a connecting web 26 having a first or upper leg 28 extending laterally from an upper web end and a base or lower leg 30 at a lower web end. The base or lower leg 30 may be provided with fastener re-ceiving apertures 32 which facilitate installation of the clip 22. In the preferred arrangement, the connecting web 26 is apertured, as illustrated in FIG. 1, to minimize the cross-sectional area available for through-conduction of heat between the lower leg 30 and the upper leg 28. The connecting web 26 is provided with generally U-shaped columns 34 which increase the column strength of the connecting web 26. The connecting web 26 is provided with a first slot 36 forming part of first connecting means, hereinafter to be described, by which the subgirt 24 is slideably connected to the clip 22.

Figure 2:
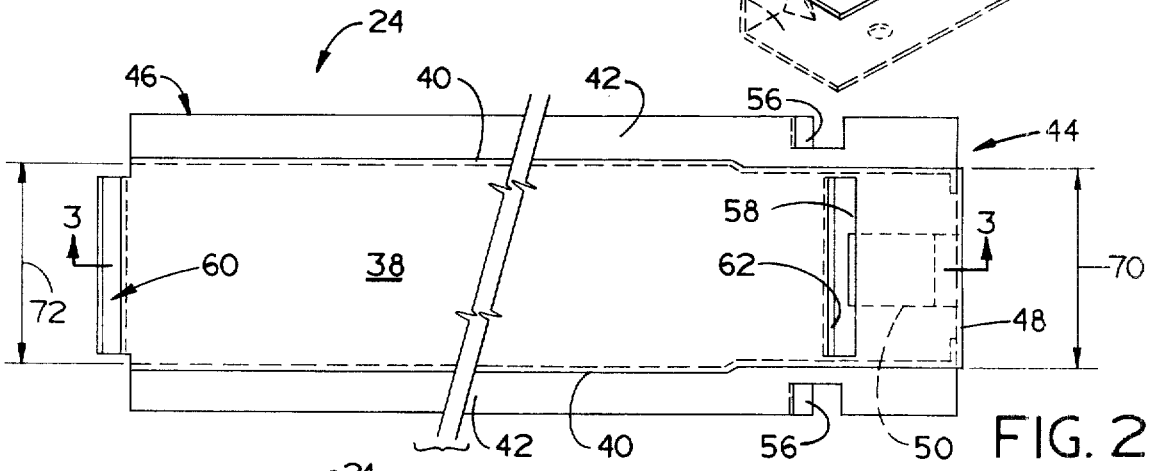
FIG. 2 is a plan view of the subgirt component.
Figure 3:
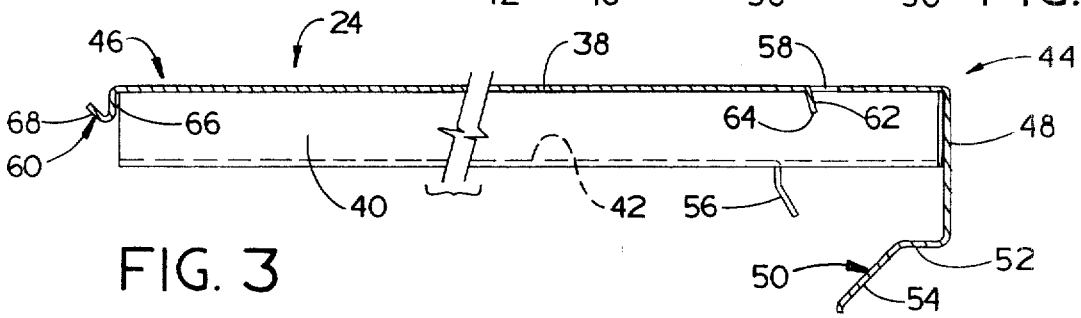
FIG. 3 is a cross-sectional view taken along the line 3—3 of FIG. 2.

Referring to FIGS. 1 through 3, the subgirt 24 may have a hat-shaped transverse profile including a central web 38, side walls 40 extending in the same direction from opposite sides of the central web 38, and coplanar flanges 42 extending outwardly from corresponding inner edges of the side walls 40. The subgirt 24 presents a first end 44 adapted to overlie the first leg 28 (FIG. 1) of the clip 22 and a second or opposite end 46. An end plate 48, preferably formed integrally with the central web 38, extends downwardly therefrom and terminates in a connecting strip 50 which, as best shown in FIG. 3, includes first and second strip segments 52, 54. The first strip segment 52 adjoins the lower end of the end plate 48 and extends inwardly therefrom beneath the central web 38. The second strip segment 54 adjoins the first strip segment 52 and is inclined downwardly relative to the plane of the first strip segment 52. The connecting strip 50 is adapted to be bent upwardly into the position illustrated in FIG. 4. Tabs 56 are provided, one integrally formed with each of the coplanar flanges 42. The tabs 56 cooperate with the connecting strip 50 to slideably connect the subgirt 24 to the clip 22, as will be described.

The subgirt 24 also is provided with second connecting means for connecting the second end 46 of each subgirt to the first end of the next-in-line subgirt. The first connecting means includes a second slot 58 formed in an exterior face—the central web 38—of the first end 44 of the subgirt 24, and a tongue 60, preferably formed integrally with the central web 38, extending longitudinally outwardly from the second end 46.

In the preferred arrangement, a web segment 62 extends downwardly from one side of the second slot 58 and terminates in an inner edge 64 best illustrated in FIG. 3. The tongue 60 (FIG. 3) preferably has a J-shaped configuration including a first tongue segment 66 extending downwardly from and generally normal to the central web 38 and a terminal tongue segment 68 inclined upwardly from the lower end of the first tongue segment 66. The J-shaped tongue 60 is adapted to be hooked under the inner edge 64 of the web segment 62 presented by the next-in-line subgirt as shown in FIG. 4.

It will be observed in FIG. 2 that the first end 44 of the subgirt is countersunk such that the external width 70 thereof is less than the internal width 72 of the second end 46. The second end 46 of each subgirt 24 is easily installed in end overlapped relation with the first end 44 of the adjacent subgirt 24.

The clip 22 and the subgirt 24 may be fabricated from sheet metal, such as for example metal coated steel or aluminum, and may have a thickness of from 0.12 to 0.152 centimeters. The clip 22 and the subgirt 24 may be provided in any desired height H and length L, respectively, see FIG. 1. Commercial embodiments of the support assembly 20 incorporate clips 22 having heights H of 7.6, 9.2, 11.8 and 14.3 centimeters thereby to accommodate insulation having thicknesses of 7.6, 10.2, 12.7 and 15.2 centimeters. The same commercial embodiments of the support assembly 20 may icorporate a subgirt 24 having a length of 15.2, 30.5, 40.6, 45.7 or 61.0 centimeters.

Figure 4:
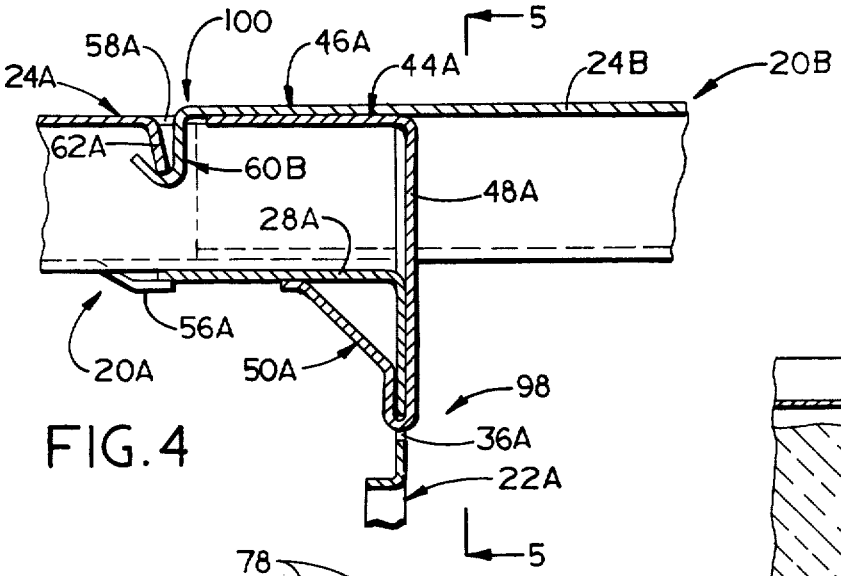
FIG. 4 is a cross-sectional view taken along the line 4—4 of FIG. 5, illustrating adjacent support assemblies assembled in end-overlapped relation.
Figure 5:
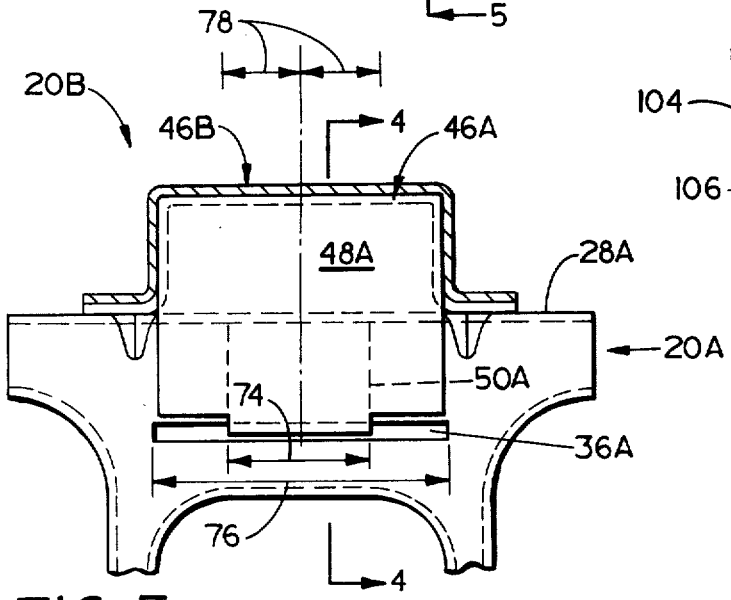
FIG. 5 is a cross-sectional view taken along the line 5—5 of FIG. 4.

FIGS. 4 and 5 illustrate adjacent support assemblies 20A, 20B in end-overlapped relation. The connecting strip 50A extends through the first slot 36A and is inclined upwardly into engagement with the lower face of the first leg 28A. The tabs 56A (only one visible in FIG. 4) are engaged beneath the first leg 28A. In accordance with this invention, the connecting strip 50A (FIG. 5) has a width indicated at 74 which is significantly less than the length 76 of the first slot 36A. The overlapped subgirts 24A, 24B are slideable in the plane of the first leg 28A in a direction parallel with the slot 36A. The subgirts 24A, 24B are moveable from the centered position illustrated in FIG. 5, in either direction through distances indicated at 78. Such movement accommodates thermal expansion and contraction of an exterior sheet which is secured to the support assemblies 20A, 20B.

It will be observed in FIG. 4, that the J-shaped tongue 60B extends downwardly through the second opening 58A and is hooked under the web segment 62A. The connection provided by the interengaged tongue 60B and web segment 62A has been found by testing to provide more than adequate resistance to the stresses introduced by negative wind loads and over the anticipated range of negative wind loads.

Figure 6:
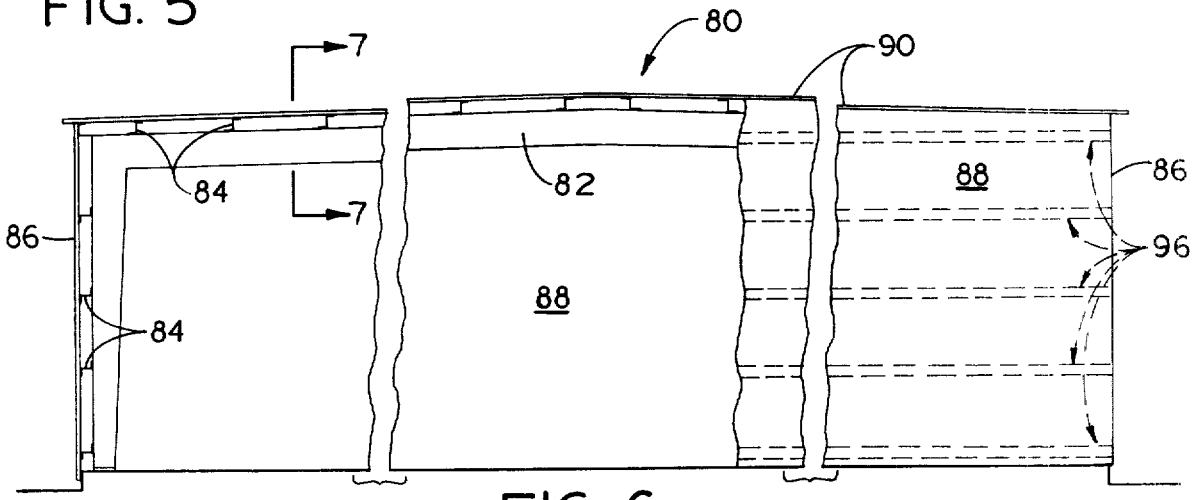
FIG. 6 is a broken end view, with parts cut away to show details, illustrating a building having roof and wall structures of this invention.

FIG. 6 illustrates a typical building 80 having plural frame members 82 (only one visible) to which horizontal purlins or girts 84 are secured. Opposite side walls 86, opposite end walls 88, and a roof structure 90 are supported on the purlins or girts 84.

Figure 7:
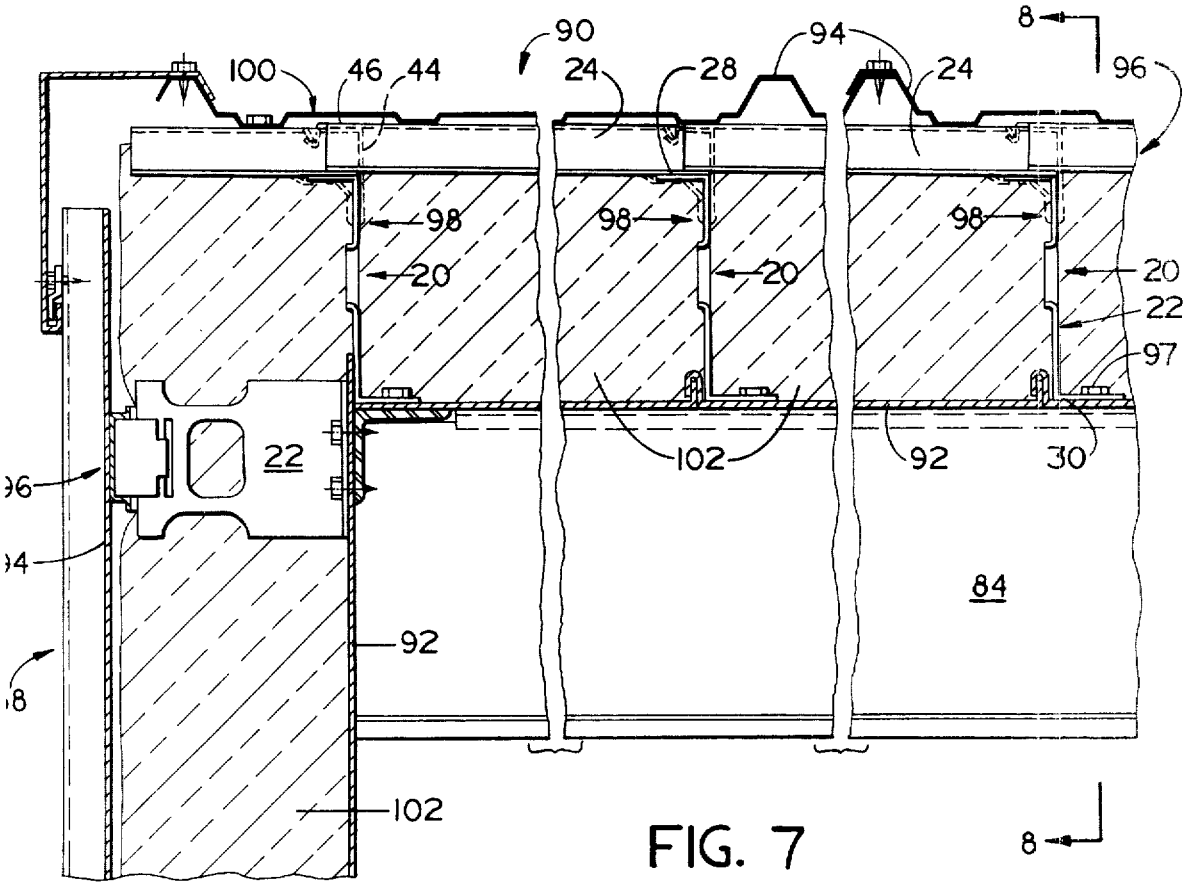
FIG. 7 is a broken cross-sectional view taken along the line 7—7 of FIG. 6.

As illustrated in FIGS. 7 and 8, the present roof or wall structure comprises an inner sheath 92 extending across and secured to each of a plurality of the spaced-apart purlins or girts 84; an outer sheath 94; and plural support means 96 extending transversely of the outer sheath 94 and supporting the same in spaced-apart relation with the inner sheath 92.

In accordance with this invention, each of the support means 96 comprises a plurality of the support assemblies 20 arranged in axially aligned relation. Each clip 22 has the base or lower leg 30 thereof secured to the inner sheath 92 by one or more fasteners 97. The number of fasteners 97 employed depends on the anticipated negative or suction load. In the preferred arrangement, each of the support means 96 is aligned along one of the purlins or girts 84 with the fasteners 97 threadedly engaged with the purlin or girt 84.

First connecting means 98 is provided which slideably connects the first ends 44 of the subgirts 24 to the adjacent clips 22 for movement parallel to the plane of the first or upper legs 28 thereby to accommodate thermal expansion and contraction of the outer sheath 94. Second connecting means 100 (FIG. 7) is provided for connecting the first and second ends 44, 46 of the subgirts 24 against disengagement under negative or suction load conditions. It will be appreciated that the first connecting means 98 comprises the connection between the connecting strip 50A and the first slot 36A, as explained above with reference to FIG. 4. It will also be appreciated that the second connecting means 100 comprises the connection between the J-shaped tongue 60B and the web segment 62A as explained above with reference to FIG. 4.

The present wall or roof structure 88, 90 also includes thermal insulation 102 disposed in the space between the inner and outer sheaths 92, 94. As best shown in FIG. 8, the thermal insulation 102 presents a normal or uncompressed depth D in the region between the support means 96. Depending on the height H of the clips 22, the insulation is uncompressed or only slightly compressed (less than one centimeter) in the region directly beneath the support means 96. The slight compression prevents the insulation 102 from sagging down sloped roofs or vertical walls. The overall arrangement is such that the thermal insulation presents a substantially uniform thickness throughout the roof or wall structure. It will therefore be appreciated that substantial compression of the insulation and the consequent loss of insulating value encountered in prior art structures is totally avoided in the present wall structure. In addition, the present wall structure accommodates thermal expansion and contraction of the outer sheath 94 thereby totally eliminating hole enlargement at the fastener locations and the consequent leaks in the roof and wall structures.

The inner and outer sheaths 92, 94 of the roof and wall structures 90, 88 in FIGS. 7 and 8 may comprise sheet metal panels of appropriate thickness. The panels of the outer sheath 94 may have any desired aesthetic profile and may be provided with weather resistant outer coating.

FIG. 9 illustrates a roof or wall structure wherein the inner sheath 92' comprises a laminate of a thin layer of thermal insulation and an impervious backing 106, such as a vinyl covering. The inner sheath 92' is interposed between the lower leg 30 of the clip 22 and the purlin or girt 84, thereby further insulating the clips 22 from the purlins or girts 84.

I claim:

1. A two-piece support assembly for sheathing panels, comprising:

a clip having a connecting web, a first leg extending laterally from an upper web end and a base at a lower web end, and a first slot in said connecting web spaced from and generally parallel with said first leg;

a subgirt having a first end overlying said first leg and a second end remote from said first leg, said subgirt including:

an end plate extending therefrom in overlapping relation with said connecting web, a connecting strip extending from said end plate through said first slot and being inclined relative to said end plate toward said first leg thereby to slideably connect said first end of said subgirt to said clip, the width of said connecting strip being less than the length of said slot;

a tongue extending longitudinally outwardly from said second end of said subgirt; and a second slot provided in an exterior face of said subgirt and being spaced from said end plate;

whereby a plurality of the support assemblies may be installed with the subgirts thereof in end-overlapped relation, and said tongue of one said support assembly engaged in the second slot of a previously installed support assembly, and with said second slot of said one support assembly receiving the tongue of a subsequently installed support assembly.

2. The support assembly of claim 1 including a web segment extending along one side of said second slot toward the plane of said first leg; and said tongue having a J-shaped configuration and being adapted to be hooked under the web segment of a next-in-line subgirt.

3. The support assembly of claim 1 wherein said subgirt presents coplanar flanges extending outwardly from opposite sides thereof and engaged with said first leg; and tabs formed integrally with said flanges and engaged beneath said first leg.

4. The support assembly of claim 1 wherein said second end has an interior width which is at least equal to the exterior width of said first end.

5. The support assembly of claim 1 wherein said connecting web of said clip is apertured to minimize the cross-sectional area available for through-conduction of heat.

6. The support assembly of claim 1 wherein said subgirt comprises a central web having said tongue and said end plate formed integrally with opposite ends thereof, side walls extending from opposite sides of said central web toward said clip, and coplanar flanges extending outwardly from corresponding inner edges of said side walls and engaged with said first leg of said clip.

7. A wall or roof structure comprising:

an inner sheath extending across and secured to each of a plurality of spaced-apart structural members;

an outer sheath;

plural support means extending transversely of said outer sheath and supporting said outer sheath in spaced-apart relation with said inner sheath; each of said support means comprising a plurality of axially spaced-apart clips having connecting webs generally normal to said inner sheath, first legs extending from outboard ends of said webs, and bases secured to said inner sheath;

a plurality of axially aligned subgirts having first end overlying the first legs of said clips and second ends overlapping the first ends of the next-in-line subgirts, said outer sheath being secured to said subgirts;

first connecting means slideably connecting said first ends to the adjacent clips for movement parallel to the plane of said first legs thereby to accommodate thermal expansion and contraction of said outer sheath;

second connecting means connecting said second ends to said first ends against disengagement thereof under suction load conditions; and thermal insulation disposed in the space between the inner and outer sheaths and having a substantially uniform thickness throughout said roof or wall structure.

8. The roof or wall structure of claim 7 wherein the connecting webs of said clips are apertured to minimize the cross-sectional area available for through-conduction of heat.

9. The roof or wall structure of claim 7 wherein each of said second connecting means comprises:

a slot provided in an outboard face of the first end of one subgirt; and a tongue extending from the second end of an overlapping subgirt through said slot.

10. The roof or wall structure of claim 9 including a web segment extending along one side of said slot toward the adjacent clip; and wherein said tongue has a J-shaped configuration and is hooked about the inner edge of said web segment.

11. The roof or wall structure of claim 7, 9 or 10 wherein each of said first connecting means comprises:

a slot in the connecting web of each clip spaced from and generally parallel with the first leg; and an end plate extending from the first end of the adjacent subgirt in overlapping relation with said connecting web, said end plate having a connecting strip extending therefrom through said slot and being inclined relative to the connecting web toward the first leg of the clip.

12. The wall or roof structure of claim 7 wherein each of said support means is aligned with one of said structural members, the bases of said clips being secured to said one of said structural members.

13. The wall or roof structure of claim 7 wherein the inner sheath comprises a thin layer of insulation having an impervious backing.

14. The wall or roof structure of claim 7 wherein each of said subgirts present coplanar flanges extending outwardly from opposite sides thereof and engaged with the first leg of the adjacent clip; and tabs formed integrally with said flanges and engaged beneath the first leg.

* * * * *